US005425438A

United States Patent [19]

Sonnendorfer et al.

[11] Patent Number: 5,425,438

[45] Date of Patent: Jun. 20, 1995

[54] DEPOSIT LOCK AND TOKEN FOR A TRANSPORT CART

[75] Inventors: Horst Sonnendorfer; Franz Wieth, both of Eichenau, Germany

[73] Assignee: Systec Ausbausysteme GmbH, Eichenau, Germany

[21] Appl. No.: 177,885

[22] Filed: Jan. 5, 1994

[30] Foreign Application Priority Data

Feb. 12, 1993 [DE] Germany ..... 43 04 116.7

[51] Int. Cl.[6] ..... G07F 7/00; G07F 1/06

[52] U.S. Cl. ..... 194/212; 194/214; 194/905

[58] Field of Search ..... 194/214, 205, 212, 213, 194/905

[56] References Cited

U.S. PATENT DOCUMENTS

| | | | |
|---|---|---|---|
| 912,397 | 2/1909 | Miller | 194/212 X |
| 965,303 | 7/1910 | Kinsey | 194/214 |
| 1,016,706 | 2/1912 | Morris . | |
| 1,266,759 | 5/1918 | Atkinson . | |
| 2,008,415 | 7/1935 | Goetz | 194/214 |
| 2,063,356 | 12/1936 | Wiggins | 194/214 |
| 4,421,220 | 12/1983 | Jaffe | 194/212 |
| 4,509,632 | 4/1985 | Jaffe | 194/212 |
| 4,691,816 | 9/1987 | Trubiano . | |

FOREIGN PATENT DOCUMENTS

| | | | |
|---|---|---|---|
| 0415805A1 | 3/1991 | European Pat. Off. . | |
| 0513661A1 | 11/1992 | European Pat. Off. . | |
| 0536611A2 | 4/1993 | European Pat. Off. . | |
| 2410856A | 6/1979 | France . | |
| 386842 | 12/1923 | Germany . | |
| 1734420 U | 6/1956 | Germany . | |
| 2346728 | 9/1973 | Germany . | |
| 2554916 | 6/1977 | Germany . | |
| 3605055 | 2/1986 | Germany . | |
| 3917172A1 | 11/1990 | Germany . | |
| 4125875 | 2/1993 | Germany | 194/905 |
| 4004495 | 1/1992 | Japan | 194/214 |
| 1101421A | 1/1968 | United Kingdom . | |
| 1564328 | 4/1980 | United Kingdom . | |
| WO90130-98A1 | 11/1990 | WIPO . | |

*Primary Examiner*—Michael S. Huppert
*Assistant Examiner*—Scott L. Lowe
*Attorney, Agent, or Firm*—Panitch Schwarze Jacobs & Nadel

[57] ABSTRACT

Deposit locks for transport carts are in use in which the coupling member of one cart is lockable in the deposit lock of the next cart, and the deposit lock has a locking mechanism which upon insertion of a deposit token into the locking mechanism locks the token while releasing the cart and releases the token upon recoupling of the cart. To prevent misuse of these deposit locks, the deposit token is provided with an additional positioning member which forms an operative connection between the deposit token and the locking mechanism necessary for the functioning of the lock.

13 Claims, 2 Drawing Sheets

DEPOSIT LOCK AND TOKEN FOR A TRANSPORT CART

FIELD OF THE INVENTION

This invention relates to a deposit lock for a transport cart, in particular a shopping cart which can be pushed into another similar cart. Each cart is equipped with a deposit lock and a coupling member, whereby the coupling member of one cart is lockable with the deposit lock of the next cart for coupling together a row of parked carts or for release of the cart, preferably from the end of the row, upon insertion of a deposit coin. The deposit lock contains a locking mechanism which locks the inserted deposit coin in place when the cart is released and returns the deposit coin when the cart is recoupled.

BACKGROUND OF THE INVENTION

Deposit locks of this type are known from DE-A-25 54 916 (British Patent specification 1 564 328) and have since been out on the market in different constructional forms. Since the release of the cart is possible only by inserting a coin in the deposit lock, and the coin can only be retrieved by the user when the cart has been recoupled at one of the various collection sites, the carts no longer stand around uselessly. Because the carts not in use would always be available at the points where needed and are no longer uselessly scattered about the area, there is a saving of personnel to look for, collect and return carts to the collection sites, and one manages with a smaller number of carts.

At the moment, deposit locks are constructed in such a way that they can be operated with 1 mark or 2 mark coins or with respective foreign currency of similar value, so that the user has sufficient incentive to return the cart to one of the collection sites after use.

Quite recently, plastic chips corresponding in size to the respective deposit coins are being offered as substitutes for the above-mentioned deposit coins and in their place permit activation of the deposit lock. At this time, these plastic chips are still being widely offered at the price of the coins for which they substitute. However, the production cost of the plastic chips is only on the order of a few cents. One must therefore take into account that these chips will soon be able to be acquired at a much lower cost. Naturally, the incentive to return the shopping cart to a collection site will hardly still be there, and the deposit system will largely lose its purpose.

From this viewpoint, the object of the present invention is to improve upon the above-described deposit system, so that its misuse through lesser valued chips and the like is precluded. A solution first considered by the inventors to prevent the misuse of deposit locks was to install coin testers similar to those used in vending machines, which detect not only the diameter of the coin, for example, but also its weight, its thickness or the like. However, with this, the price of the deposit lock would be uneconomically high.

SUMMARY OF THE INVENTION

According to the present invention, the above problem is solved by providing the deposit token with an additional positioning member so that by direct or indirect release of the cart, the operative connection between the deposit token and/or its positioning member on the one hand and the locking mechanism on the other hand is carried out.

The invention therefore proceeds from the recognition not to work with expensive testing devices in the deposit lock, but to change the deposit token itself. The deposit system is raised to a higher technical level, in which an additional functioning and distinguishing effect is given to the deposit token. The misuse through simply-produced plastic pieces or the like is thereby ruled out.

A further advantage of the invention lies in the fact that in most border areas where the currency of the neighboring country is also used, the deposit lock does not need to be equipped with two different coin channels and locking mechanisms, but instead the deposit token of this invention can be employed.

The mode of operation of the additional positioning member can be varied. First, the positioning member can be used as a prerequisite to bring the deposit token generally into the correct position in the deposit lock. The positioning member could perhaps cooperate with the guide rails of the deposit lock and the deposit token will thereby be held in a position independent of its periphery. Likewise, it is, however, also possible that the positioning member itself works in operational connection with the locking mechanism, whereby the release of a neighboring cart or the locking of the deposit token is automatically achieved.

For the construction of the positioning member, there are likewise several possibilities. The positioning member can be an magnet integrated into the deposit token, or an element projecting or receding with respect to one or both sides of the periphery of the deposit token, such as a peg, a ball or the like. There is also the possibility to affix the positioning member to the deposit token so that it is displaceable instead of stationary.

Also within the scope of this invention are positioning members only in the form of individual surface formations on the deposit token, such as special elevations, grooves, slits or the like.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
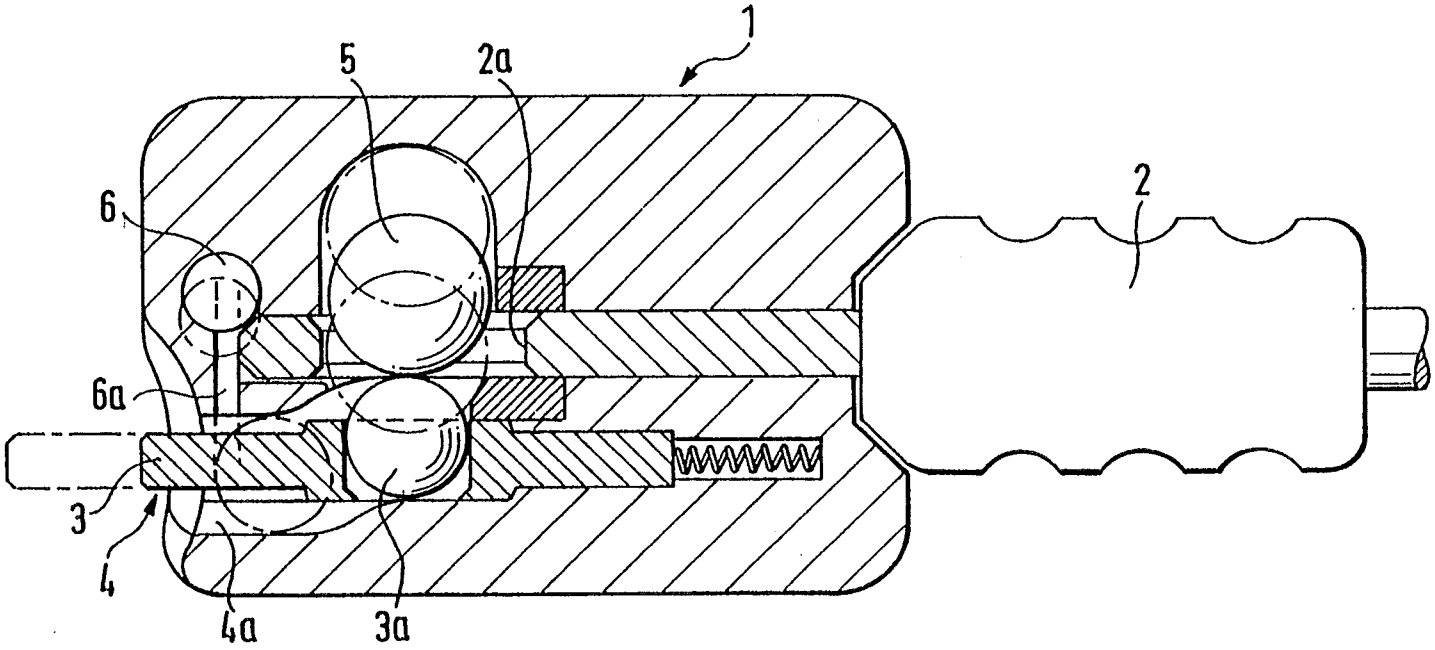
FIG. 1 shows a vertical cross-section through the deposit lock according to a first embodiment.

In FIG. 1 the deposit lock 1 is shown attached in any desired manner to a shopping cart (not shown). A coupling element in the form of a key 2 sticks into the lock 1 of a deposit automat on a shopping cart standing at the front of a row of carts (likewise not shown). If the cart is to be uncoupled from the deposit automat, then a deposit token 3 must be inserted into the automat. The operation of the automat is based upon a well known lock mechanism, of which more will be said later, that on the one hand when the key is pulled out, the cart with the deposit lock 1 can be driven away, and on the other hand at the same time the deposit token 3 is locked in the deposit lock 1.

There are an abundance of constructional forms of locking mechanisms of this type on the market. For that reason, the locking mechanism will only be described with reference to the embodiment of FIG. 1. The other figures are similar constructions with the same principle intended, and like reference numerals are used to designate like elements therein.

Important is the construction of the deposit token 3. The token has in its center a bore in which is displaceably trapped a ball 3*a*. To guide the ball 3*a* the coin shaft 4 has a curved path 4*a* whose profile corresponds with the diameter of the ball 3*a*. This curved path is formed as a depression at the beginning of the coin shaft 4, but runs upwardly inside the deposit lock 1, so that upon inserting the deposit token 3, the ball 3*a* is raised from its original dotted-line (phantom) position to the position shown in solid lines. By this movement a blocking member 5, arranged above the ball 3*a* and which can also have the form of a ball, is raised up into the position shown in solid lines. The blocking member 5 remains thereby still partly in engagement with the bore 2*a* of the key 2. Perhaps the bottom third of the ball 5 still projects into the bore 2*a* of the key, but no longer prevents the key from being pulled out toward the right. If the key 2 is pulled out or, as happens in practice, the shopping cart with the deposit lock 1 is pulled toward the left out of the row of carts, the left edge of the bore 2*a* pushes the ball 5 slightly higher and can then be pulled out of the lock 2.

Simultaneously, the operative connection between the key 2 and the blocking element 6 is released. By this the locking element 6 drops down to the phantom position where its extension 6*a* engages the periphery of the deposit token 3. The deposit token 3 can thereby no longer be removed from the deposit lock.

When after use the cart is again to be coupled to collection site, the user inserts the key 2 of the last cart in the row into the automat lock 1. The ball 5 is thereby briefly raised until it can slip down into the bore 2*a*, and simultaneously the blocking element 6 is pushed upward from its locking position in the deposit token 3. The key 2 is only temporarily held by friction in this position in the deposit automat. Because of the raised locking element 6, the deposit token 3 can now be removed. With this, the space once occupied by the positioning member 3*a* underneath the ball 5 is now free, and the ball 5 can therefore slip into its lower (phantom) resting position and by its form thereby arrests the key 2.

Figure 2:
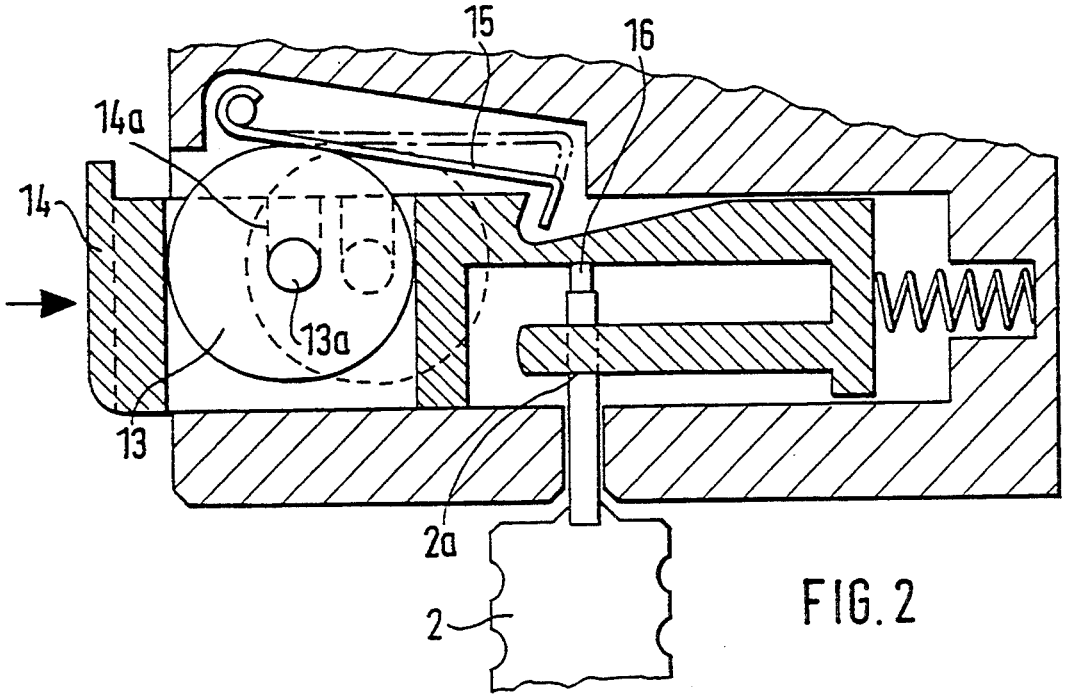
FIG. 2 shows a vertical cross-section through a deposit lock according to a second embodiment.

FIG. 2 shows another embodiment wherein, for the sake of simplicity, note will only be taken of the operation of the positioning member arranged on the deposit token. As in the previous embodiment, the deposit token takes the shape of a circular piece 13 which, however, has at its center a cylindrical pin 13*a* projecting from both sides. The pin 13*a* cooperates with guide surfaces in the form of two upwardly opening grooves 14*a* on both sides of the deposit token in a slide 14. Through this, the deposit token 13 is held at an artificially raised level, whereby its lower edge lies several millimeters above the floor of the coin slide or the coin shaft. In this way, the deposit token pushes a blocking member 15 arranged above it out of the blocking position and raises it up to the phantom position, whereby the key 2 is directly or indirectly released. The arresting of the coin slide 14 in the pushed-in position occurs by means of a spring-like locking element 16, which is vertically displaceably supported in the lock housing and also ejects the key, or through other known blocking elements.

Figure 3:
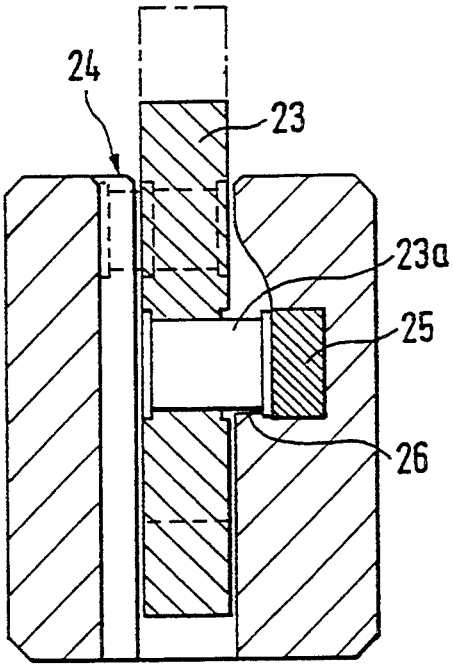
FIG. 3 shows a vertical cross-section through a deposit lock according to a third embodiment.

FIG. 3 shows a section of a further embodiment, whereby the deposit token 23 has a transversely displaceable pin 23*a* at its center. This pin is not transformed to the release position like the ball 3*a* in FIG. 1, rather it comprises a magnetically responsive material, so that a built in magnet 25 in the coin shaft 24 pulls the pin from the phantom position on the left to the solid position on the right. In this position it serves as a catch against the edge 26 in the coin shaft, securing the deposit token from falling through and holding it in a release position similar to FIG. 2, in order to block a blocking element 15 (not shown). Alternatively, the pin 23*a* could itself be a magnet, in which case the built-in element 25 would be made of magnetically responsive material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A deposit lock for a transport cart which can be pushed into a cart of the same type, each cart being equipped with a deposit lock and a coupling member, such that the coupling member of one cart is lockable into the deposit lock of the next cart for coupling together a row of parked carts and for releasing the cart on insertion of a deposit token into said deposit lock, said deposit lock having a locking mechanism which locks in an inserted deposit token when said cart is released and releases the deposit token when said locking mechanism of said cart is recoupled to a coupling member of another said cart, said deposit token (3, 13, 23) having a positioning member (3*a*, 13*a*, 23*a*), which forms an operative connection between the deposit token (3, 13, 23) on the one hand and the locking mechanism (5, 15) on the other hand.

2. A deposit lock according to claim 1, wherein the positioning member (3*a*, 13*a*) cooperates with at least one guide path (4*a*, 14*a*) in the deposit lock.

3. A deposit lock according to claim 1, wherein the positioning member (3*a*) itself comes into working connection with the locking mechanism.

4. A deposit lock according to claim 1, wherein the positioning member (23*a*) is moved by a magnet (25) in the deposit lock.

5. A deposit lock according to claim 1, wherein the positioning member (23*a*) comprises a magnet which cooperates with a magnetically responsive material in the deposit lock.

6. A deposit lock according to claim 1, wherein the positioning member (3*a*, 13*a*, 23*a*) comprises an element which projects from the periphery of the deposit token (3, 13, 23).

7. A deposit lock according to claim 1, wherein the positioning member (3*a*, 23*a*) is movably contained in the deposit token (3, 23).

8. A deposit lock according to claim 1, wherein the positioning member (13*a*, 23*a*) is a cylindrical peg.

9. A deposit lock according to claim 1, wherein the positioning member (3*a*) is a ball.

10. A deposit token for operating deposit locks on transport carts, said token having a peripheral surface and at least one positioning member extending from at least one side of said surface for cooperation with a locking mechanism in lock to release a cart, said positioning member being displaceably maintained in said token.

11. A deposit token according to claim 10, wherein said positioning member comprises a ball.

12. A deposit token according to claim 10, wherein said positioning member comprises an at least magnetically responsive material.

13. A deposit token according to claim 10, wherein said token has a circular section and said positioning member comprises a pin extending from at least one surface of the circular section.

* * * * *